United States Patent [19]

Espenscheid et al.

[11] 4,035,281

[45] July 12, 1977

[54] PRODUCTION OF FUEL OIL

[75] Inventors: Wilton F. Espenscheid, Princeton, N.J.; Tsoung-Yuan Yan, Philadelphia, Pa.

[73] Assignee: Mobil Oil Corporation, New York, N.Y.

[21] Appl. No.: 664,322

[22] Filed: Mar. 5, 1976

[51] Int. Cl.[2] ..... C10G 1/04

[52] U.S. Cl. ..... 208/8; 44/51

[58] Field of Search ..... 208/8, 10; 44/51; 201/23

[56] References Cited

U.S. PATENT DOCUMENTS

| | | | |
|---|---|---|---|
| 2,931,765 | 4/1960 | Glinka | 208/8 |
| 3,375,188 | 3/1968 | Bloomer | 208/8 |
| 3,642,608 | 2/1972 | Roach et al. | 208/8 |
| 3,705,092 | 12/1972 | Gatsis | 208/8 |
| 3,849,287 | 11/1974 | Gleim et al. | 208/8 |
| 3,870,621 | 3/1975 | Arnold et al. | 208/8 |
| 3,966,584 | 6/1976 | Gray et al. | 208/8 |

*Primary Examiner*—Delbert E. Gantz
*Assistant Examiner*—James W. Hellwege
*Attorney, Agent, or Firm*—Charles A. Huggett; Carl D. Farnsworth

[57] ABSTRACT

This invention provides a process which involves solubilizing coal in a thermally stable refinery petroleum solvent to form a homogeneous solution, and blending the homogeneous solution with petroleum cutter-stock to produce No. 5 fuel oil.

1 Claim, No Drawings

PRODUCTION OF FUEL OIL

BACKGROUND OF THE INVENTION

Natural resources provide substantially all of man's energy source materials in the form of fossil fuels, wood and other types of plant life.

Wood and coal have been a principle source of fuel for hundreds of years. Within the last one hundred years, petroleum has become the overwhelming primary commodity for the generation of energy. Petroleum has had the advantages of low cost and ease of transportation and storage because of its liquid consistency. Further, petroleum is readily amenable to fractionation and conversion into a variety of valuable industrial products such as fuels, building products, chemical intermediates, and the like.

Recent international economic developments have signaled the inevitable decline of petroleum as the world's supreme industrial commodity. The price of raw petroleum has increased several fold. Also, the consumption of petroleum has been increasing exponentially, and concomitantly the world petroleum supply has diminished to less than several decades of proven reserves.

Governments and industrial concerns on a priority basis are dedicating increased attention to alternatives to petroleum as sources for fuels and chemical intermediates, i.e., coal and wood. Substantial reserves of coal exist in highly industrialized countries, and wood is both plentiful and replenishable worldwide.

Since most current energy utilization technology requires liquid energy media, it has become an important research and development objective to provide innovative means to convert coal into liquid sources of potential energy.

It was recognized by early workers that coal can be liquified by controlled heating in the substantial absence of oxygen. The conversion products are a liquid and a char. Because of the new compelling economic factors, the technology of coal liquefaction and gasifiation has been expanding at an accelerated pace. Pioneer developments in the field are represented by Lurgi and Fischer-Tropsch techology. More recent advances in coal liquefaction are described in U.S. Pat. Nos.: 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

There remains a pressing need for new technology for the conversion of coal into liquid carbonaceous products to complement and to enhance conventional petroleum derived energy applications. Innovative processes for liquefaction of coal are required which are not dependent on high pressure or reducing gases or catalysts for efficient and economic liquefaction of coal.

Accordingly, it is an object of the present invention to provide an improved method for converting solid carbonaceous materials into liquid derivatives having application as fuels.

It is another object of the present invention to provide a process for liquefaction of carbonaceous materials without the use of high pressures or reducing gases or catalysts.

It is another object of the present invention to solubilize coal to form homogenous solutions which are directly applicable as liquid fuels.

It is a further object of the present invention to upgrade low value refractory petroleum residua from refinery operations into liquid fuel media.

Other objects and advantages of the present invention shall become apparent from the accompanying description and examples.

DESCRIPTION OF THE INVENTION

One or more objects of the present invention are accomplished by a process for converting solid carbonaceous materials into a fuel oil of low sulfur and ash content which comprises forming a slurry by admixing comminuted coal with a petroleum solvent selected from thermally stable refinery petroleum fractions having a boiling range between about 450° F and 1100° F comprising cycle oils and higher boiling product materials; heating said slurry to a temperature in the range between about 350° F and 850° F for a period of time sufficient to solubilize substantially the comminuted coal to form a homogenous solution phase; separating the homogeneous solution phase from ash and other undissolved solids; and blending said homogeneous solution phase with sufficient light petroleum hydrocarbon oil boiling above about 450° F to qualify the blended product as No. 5 fuel oil.

Optionally, in the invention process the light petroleum hydrocarbon oil can be blended with the formed homogeneous solution phase resulting from the heating and solubilization step before being subjected to a filtration, centrifugation, settling or other conventional procedure for separation of ash and other undissolved solids therefrom.

By the term "thermally stable" refinery petroleum fractions is meant a relatively high boiling conversion product such as obtained by fluidized catalytic cracking (FCC) to provide a main column bottoms or thermofor catalytic cracking (TCC) to provide "syntower" bottoms which contain a substantial proportion of polycyclic aromatic hydrocarbon constituents such as naphthalene, dimethylnaphthalene, anthracene, phenanthrene, fluorene, chrysene, pyrene, perylene, diphenyl, benzothiophene, and their derivitives Such refractory petroleum media or bottoms are highly resistant to conversion to lower molceular products by conventional non-hydrogenative procedures. Typically, these petroleum refinery bottoms and some lower boiling recycle fractions are hydrocarbonaceous mixtures having an average carbon to hydrogen ratio in the range of 0.6–1.3 and a boiling point above about 450° F.

The high boiling petroleum solvents employed in the practice of the present invention process are preferably thermally stable, highly polycyclic aromatic rich mixtures which result from one or more petroleum refining operation comprising catalytic cracking. Representative heavy or high boiling petroleum solvents include main column bottoms, syntower bottoms; asphaltic material; propane-deasphalted tar; coker gas oil; heavy cycle oil; clarified slurry oil; mixtures thereof, and the like.

The nominal properties of suitable petroleum solvents as as follows:

| Main Column Bottoms | |
|---|---|
| Sulfur | 1.13% |
| Nitrogen | 450 ppm |
| Pour Point | 50° F |
| 5% Boiling Point | 640 |

-continued

| | |
|---|---|
| 95% Point | 905° F |
| Conradson Carbon | 9.96 |

| Clarified Slurry Oil | |
|---|---|
| Sulfur | 1.04% |
| Nitrogen | 4400 ppm |
| Pour Point | 50° F |
| 5% Boiling Point | 630 |
| 95% Point | 924° F |
| Conradson Carbon | 10.15 |

| Heavy Cycle Oil | |
|---|---|
| Sulfur | 1.12% |
| Nitrogen | 420 ppm |
| 5% Boiling Point | 450 |
| 95% Point | 752° F |
| Conradson Carbon | 0.15 |

An FCC "main column" bottoms product fraction boiling above 600° F is a highly preferred solvent for the practice of the present invention process. A typical FCC main column bottoms contains a mixture of chemical constituents as represented in the following mass spectrometic analysis:

| Compounds | Aromatics | Naphthenes Aromatics | Labile $H_2$% |
|---|---|---|---|
| Alkyl Benzene | 0.4 | | 0 |
| Naphthene Benzenes | | 1.0 | 0.03 |
| Dinaphthene Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 5.4 | | |
| Naphthobenzothiophenes | | 22.4 | 0.04 |
| Total | 64.4 | 35.6 | 0.60 |

A typical FCC main column bottoms has the following nominal analysis and properties:

| Elemental Analysis, Wt. %: | |
|---|---|
| C | 89.93 |
| H | 7.35 |
| O | 0.99 |
| N | 0.44 |
| S | 1.09 |
| Total | 99.80 |
| Pour Point, ° F: | 50 |
| CCR, %: | 9.96 |
| Distillation: | |
| IBP, ° F: | 490 |
| 5%, ° F: | 640° F |
| 95%, ° F: | 905 |

FCC main column or TCC syntower bottoms are obtained as distillate product fractions from the catalytic cracking of gas oil in the presence of a solid porous catalyst. A light cycle oil product or distillate fraction has a boiling range between about 500° F and 650° F.

It has been found that FCC main column bottoms is an excellent thermally stable solvent for solublizing coal. This material has a labile hydrogen content of about 0.3 percent or more, a benzylic hydrogen ($\alpha$) content of 1.5 percent or more, an aromatic hydrogen content of 2 percent or more, and a content of $\beta,\gamma$ and other hydrogen of 4 percent or less.

The nominal analyses of various coals suitable for use in the invention process are as follows:

| High Volatile (A) Bituminous (Coal) | |
|---|---|
| Sulfur | 1.33% |
| Nitrogen | 1.63 |
| Oxygen | 7.79 |
| Carbon | 80.88 |
| Hydrogen | 5.33 |
| Ash | 2.77 |
| **Sub Bituminous (Coal)** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

The blending solvent is preferably a light hydrocarbon oil boiling in the range between about 300° F and 650° F. The hydrocarbon components of the solvent mixture generally will be cyclic and alicyclic compounds containing between 8 and about 20 carbon atoms. A particularly preferred type of light hydrocarbon blending solvent is a light cycle stock derived from thermofor catalytic cracking or fluidized catalytic cracking refinery operations. Illustrative of suitable refinery cutter-stock solvents are FCC light cycle stock (420°–650° F, $C_{12}$–$C_{20}$), light coker gas oil (400°–650° F, $C_{12}$–$C_{20}$), kerosene (300°–550° F, $C_9$–$C_{16}$), and the like.

In the invention process, the thermally stable petroleum component performs as a solvent medium with respect to the solubilization of the comminuted coal. The petroleum solvent and coal components are admixed to form a slurry. The slurry thus formed is heated at a temperature in the range between about 350° F and 850° F, and preferably at a temperature between about 500° F and 750° F. In the invention process, a closed or open system under moderate or high pressure may be employed. It is not necessary to contact the liquefaction medium with a reducing gas such as hydrogen or synthesis gas although the present invention does not exclude the use of reducing gas.

In the invention process, the slurry is heated for a reaction time sufficient to yield a homogeneous solution phase which upon cooling to ambient temperatures remains homogeneous and has a flowable consistency. The heating step of the invention process is conducted for a period of time between 0.2 and 3 hours, and preferably for a period of time between about 0.5 and 1.5 hours. Although it is not essential, the liquefaction reaction can be conducted under pressure and/or in the presence of a reducing gas (e.g., under a hydrogen pressure of about 100–2000 psi).

The petroleum solvent component in the liquefaction reaction mixture is provided in a quantity between about 0.5 and 10 parts by weight per part by weight of the comminuted coal component. Normally, the preferred ratio will be in the range between about 1.0 and 5 parts by weight of petroleum solvent per part by weight of coal.

The quantity of light hydrocarbon solvent blended into the homogeneous liquefaction solution can vary over a wide range of proportions, depending on the sulfur and ash content and the flow properties of the homogeneous liquefaction solution being diluted. The quantity of light hydrocarbon solvent blended may vary between about 0.05 and 5 volumes of solvent per volume of liquefaction solution.

The homogeneous solution phase which is a resultant intermediate product of the liquefaction and solubilization step of the invention process typically is a flowable pitch-like composition which contains a suspension of ash and other insoluble solids.

In one embodiment, the liquefaction product mixture of liquid and solid phases is subjected to a filtration, centrifugation or other such proceduce to separate the solid and liquid phases. Preferably, the separation procedure is conducted at an elevated temperature between about 300° F and 500° F to improve the flow properties and facilitate the operation. The separated homogeneous solution phase is then blended with a sufficient quantity of light hydrocarbon solvent to yield a blended hydrocarbonaceous liquid which meets the specification of No. 5 fuel oil.

In another embodiment of this invention, the light hydrocarbon solvent and the homogeneous liquefaction solution are blended prior to the removal of ash and insoluble solids by filtration or other means for separating the liquid and solid phases which result from the liquefaction and solubilization step of the invention process. The dilution of the homogeneous liquefaction solution with light hydrocarbon solvent prior to the separation of liquid and solid phases is advantageous, since it lowers the viscosity of the liquid phase, coagulates the colloidal particles, and permits the separation of liquid and solid phases to be accomplished at lower temperatures or at ambient temperatures.

In another highly preferred embodiment of the present invention, comminuted coal is admixed with light FCC cycle oil and main column or syntower bottoms (between about 1 and 10 parts per part by weight of coal), then the admixture is heated to solubilize the coal into a homogeneous liquefaction solution, and the said homogeneous solution is separated from insoluble solids. The solution thus obtained from the process qualifies without further modification for useage as No. 5 fuel oil.

As described hereinabove, the final product of the invention process is a hydrocarbonaceous blend which meets the specifications of No. 5 fuel oil. Nominally, a No 5 grade of fuel oil has a maximum water and sediment volume of 1 percent, a maximum of 0.1 percent by weight of ash, and a maximum of 2 percent by weight of sulfur. Saybolt Viscosity (Universal at 100° F) for light No. 5 fuel oil is about 150–300, and for heavy No. 5 fuel oil is about 350–700.

The following examples are further illustrative of the present invention. The reactants and other specific ingredients are presented as being typical, and various modifications can be derived in view of the foregoing disclosure within the scope of the invention.

EXAMPLE I

Production of No. 5 Fuel Oil From Coal, FCC Main Column Bottoms. and Cutter-Stock One hundred grams of lignite is mixed with 100 grams of FCC Main Column bottoms. The mixture is heated at a temperature of 750° F for 1 hour with stirring in a closed autoclave, without added hydrogen. After cooling, a uniform viscous product is recovered from the reactor. The pour point of the product is greater than 400° F. About 65 weight percent of the coal is converted to pyridine solubles.

Upon addition of 30 weight percent FCC light cycle stock, the resultant fluid mixture is filtered at 250° F. The ash content of the final product is below 0.1 percent the viscosity is about 100 cs at 100° F.

EXAMPLE II

Production of No. 5 Fuel Oil From Coal and Light FCC Main Column Bottoms

Forty grams of high volatile A coal is mixed with 200 grams of light FCC main column bottoms. The mixture is heated to 750° F for 1 hour with stirring in a closed autoclave, without added hydrogen. A uniform fluid product is recovered from the reactor and filtered at 350° F. Analysis of the coal portion shows that 90 weight percent of the coal is converted to pyridine solubles.

The product yield based on m.a.f. coal is:

| | wt. % |
|---|---|
| Benzene Solubles | 34.2 |
| Benzene Insolubles | 51.9 |
| Gas | 3.3 |
| Water | 2.8 |
| Unreacted Coal | 9.8 |

The final product solution obtained after filtration contains less than 0.1 percent ash, and has a viscosity of 100 cs at 100° F.

Having thus generally described the invention and discussed specific embodiments in support thereof, it is to be understood that no undue restrictions are to be imposed by reasons thereof except as defined by the following claims:

We claim:

1. A process for producing No. 5 fuel oil which comprises forming a slurry by admixing comminuted coal with light FCC cycle oil and FCC main column bottoms of TCC syntower bottoms; heating said slurry at a temperature in the range between about 350° F and 850° F for a period of time sufficient to solublize substantially the said coal to form a homogeneous solution phase; separating the homogeneous solution phase from ash and other undissolved solids; and recovering the separate solution phase as No. 5 fuel oil.

* * * * *

UNITED STATES PATENT AND TRADEMARK OFFICE

CERTIFICATE OF CORRECTION

PATENT NO. : 4,035,281

DATED : July 12, 1977

INVENTOR(S) : WILTON F. ESPENSCHEID and TSOUNG-YUAN YAN

It is certified that error appears in the above-identified patent and that said Letters Patent are hereby corrected as shown below:

| | |
|---|---|
| Column 1, line 55 | "pressure" should be -- pressures --. |
| Column 2, line 42 | "derivitives" should be -- derivatives --. |
| Column 6, line 53 | "of" should be -- or --. |

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*